US008393392B2

(12) United States Patent
Mytopher et al.

(10) Patent No.: US 8,393,392 B2
(45) Date of Patent: Mar. 12, 2013

(54) METHOD AND APPARATUS FOR PERFORATING MULTIPLE WELLBORE INTERVALS

(75) Inventors: Terry Lee Mytopher, Grand Prairie (CA); Nathan Coffey, Grand Prairie (CA)

(73) Assignee: Integrated Production Services Ltd., Calgary (CA)

( * ) Notice: Subject to any disclaimer, the term of this patent is extended or adjusted under 35 U.S.C. 154(b) by 348 days.

(21) Appl. No.: 12/729,022

(22) Filed: Mar. 22, 2010

(65) Prior Publication Data

US 2010/0236781 A1 Sep. 23, 2010

Related U.S. Application Data

(60) Provisional application No. 61/161,951, filed on Mar. 20, 2009.

(51) Int. Cl.
*E21B 29/00* (2006.01)

(52) U.S. Cl. ..... 166/297; 166/299; 166/55; 175/4.55

(58) Field of Classification Search ..... 175/4.52, 175/4.55, 4.54; 166/297, 55.1
See application file for complete search history.

(56) References Cited

U.S. PATENT DOCUMENTS 4,540,051 A 9/1985 Schmuck et al.
4,823,882 A 4/1989 Stokley et al.
5,355,957 A * 10/1994 Burleson et al. ..... 166/297
5,372,193 A * 12/1994 French ..... 166/250.08
6,131,662 A 10/2000 Ross
6,394,184 B2 5/2002 Tolman et al.
6,491,098 B1 12/2002 Dallas
6,543,538 B2 4/2003 Tolman et al.
6,568,474 B2 5/2003 George et al.
6,637,508 B2 10/2003 Marsh et al.
6,957,701 B2 10/2005 Tolman et al.
2010/0051278 A1 3/2010 Mytopher et al.

OTHER PUBLICATIONS

NCS Energy Services, Inc. website, Coil Tubing Fracturing, Sep. 24, 2008.

* cited by examiner

*Primary Examiner* — Kenneth L Thompson
*Assistant Examiner* — Ronald Runyan
(74) *Attorney, Agent, or Firm* — Bennett Jones LLP

(57) ABSTRACT

A bottom hole assembly for one trip perforating and treating a wellbore, the bottom hole assembly including: a tool body including an outer surface and an upper end; a fluid passage extending into the tool body from the upper end; a valve to provide (i) in one orientation fluid access from the fluid passage to an outlet port opening to the outer surface and (ii) in another orientation fluid access from the fluid passage to a perforating gun actuation fluid supply channel while sealing fluid access from the fluid passage to the outer surface; an annular sealing member encircling the outer surface below the outlet port; and a perforating gun carried below the resettable, annular sealing member and hydraulically actuable to detonate by fluid communication through the perforating gun actuation fluid supply channel.

17 Claims, 5 Drawing Sheets

METHOD AND APPARATUS FOR PERFORATING MULTIPLE WELLBORE INTERVALS

FIELD

The invention relates generally to the field of perforating and possibly also treating subterranean formations.

BACKGROUND

Perforating guns are used to access the formation behind a wellbore casing. In wellbore operations it is common to run into and out of a well a number of times to perforate and treat the well. However, the increasing costs of well bore operations, including the rental rates for a rig and lost time, are urging operators to find faster ways of conducting wellbore service operations including those relating to wellbore perforating.

SUMMARY

In accordance with a broad aspect of the present invention there is provided a bottom hole assembly for one trip perforating and treating a wellbore, the bottom hole assembly including: a tool body including an outer surface and an upper end; a fluid passage extending into the tool body from the upper end; a valve to provide (i) in one orientation fluid access from the fluid passage to an outlet port opening to the outer surface and (ii) in another orientation fluid access from the fluid passage to a perforating gun actuation fluid supply channel while sealing fluid access from the fluid passage to the outer surface; an annular sealing member encircling the outer surface below the outlet port; and a perforating gun carried below the annular sealing member and hydraulically actuable to detonate by fluid communication through the perforating gun actuation fluid supply channel.

In accordance with another broad aspect of the present invention, there is provided a method for perforating and treating a well having a wellbore wall including: (a) providing a bottom hole assembly including a tool body including an outer surface and an upper end; a fluid passage extending into the tool body from the upper end; a valve to provide (i) in one orientation fluid access from the fluid passage to an outlet port opening to the outer surface and (ii) in another orientation fluid access from the fluid passage to a perforating gun actuation fluid supply channel while sealing fluid access from the fluid passage to the outer surface; an annular sealing member encircling the outer surface below the outlet port; and a perforating gun below the resettable, annular sealing member and hydraulically actuable to detonate by fluid communication through the perforating gun actuation fluid supply channel; (b) running the bottom hole assembly to a position in the well; (c) actuating the valve to provide fluid access from the fluid passage to the perforating gun actuation fluid supply channel to detonate the perforating gun to create perforations in the wellbore wall; (d) moving the bottom hole assembly to set the annular sealing member to seal an annulus between the bottom hole assembly and the wellbore wall below the perforations; (e) treating the well by communicating treatment fluid to the perforations; and (f) unsetting the annular sealing member.

In accordance with another broad aspect of the present invention, there is provided a tool for perforating and treating a wellbore interval comprising: a body having an exterior surface, an inlet fluid passage and a perforating fluid passage openable into communication with the inlet fluid passage; a first hydraulically operated perforating device openable into communication with the perforating fluid passage; a second hydraulically operated perforating device openable into communication with the perforating fluid passage; a wellbore sealing mechanism annularly positioned about the body; and a valve for controlling fluid flow through the inlet fluid passage to communicate the fluid to the perforating fluid passage and to communicate the fluid to the exterior of the tool above the wellbore sealing device, the valve being operable by reacting to pressure differentials between the exterior of the tool and the inlet fluid passage.

In accordance with another broad aspect of the present invention, there is provided a method for perforating and treating multiple intervals in a well, said method comprising: (a) running into the well with a tool having a body including an exterior surface, an inlet fluid passage and a perforating fluid passage openable into communication with the inlet fluid passage; a first hydraulically operated perforating device openable into communication with the perforating fluid passage; a second hydraulically operated perforating device openable into communication with the perforating fluid passage; a wellbore sealing mechanism annularly positioned about the body; and a valve for controlling fluid flow through the inlet fluid passage to communicate the fluid to the perforating fluid passage and to communicate the fluid to the exterior of the tool above the wellbore sealing device, the valve being operable by pressure differentials between the exterior of the tool and the inlet fluid passage; (b) actuating the valve to open fluid communication to the perforating fluid passage and sealing fluid communication to the exterior of the tool and hydraulically actuating the first hydraulically operated perforating device to create perforations in a first interval of the well; (c) setting the wellbore sealing mechanism to create a hydraulic seal in the well; (d) actuating the valve to open fluid communication to the exterior of the tool and pumping treating fluid through the inlet fluid passage and the valve to the exterior of the tool and into communication with the perforations in the first interval of the well; (e) releasing the sealing mechanism; and (f) repeating steps (b) to (e) to hydraulically actuate the second hydraulically operated perforating device to create perforations in a second interval of the well and to communicate treating fluid to the perforations in the second interval.

In accordance with another broad aspect of the present invention, there is provided a method for perforating and treating multiple intervals in a well, said method comprising: (a) running into the well with a tool having a body including an upper end, an exterior surface and a fluid passage extending into the body from the upper end; a first hydraulically operated perforating device openable into communication with the fluid passage; a second hydraulically operated perforating device openable into communication with the fluid passage; a wellbore sealing mechanism annularly positioned about the body; and a valve for controlling fluid flow through the fluid passage to actuate the first and the second hydraulically operated perforating devices and to communicate the fluid to the exterior of the tool above the wellbore sealing device; (b) creating a pressure differential across the valve to actuate the valve to close fluid communication between the fluid passage and the exterior surface of the tool and to provide sufficient fluid pressure to the first hydraulically operated perforating device such that the first hydraulically operated perforating device creates perforations in a first interval of the well; (c) setting the wellbore sealing mechanism to create a hydraulic seal in the well; (d) reducing the pressure differential across the valve such that fluid communication is opened from the fluid passage to the exterior surface of the tool and pumping treating fluid through the fluid passage and the valve to the exterior surface of the tool and into communication with the perforations in the first interval of the well; (e) releasing the wellbore sealing mechanism; and (f) repeating steps (b) to (e) to hydraulically actuate the second hydraulically operated perforating device to create perforations in a second interval of the well and to communicate treating fluid to the perforations in the second interval.

In accordance with another broad aspect of the present invention, there is provided a perforating device for sequentially perforating a plurality of intervals in a well, the perforating device comprising: a first hydraulically operated perforating device; a second hydraulically operated perforating device; a fluid supply passage leading to the first hydraulically operated perforating device and to the second hydraulically operated perforating device; a first rupture disc in the fluid supply passage to control fluid flow to the first hydraulically operated perforating device, the first rupture disc providing a seal against fluid flow from the fluid supply passage to the first hydraulically operated perforating device and fluid flow to detonate the first hydraulically operated perforating device being possible only when the first rupture disc is burst by fluid pressure applied thereagainst and a second rupture disc in the fluid supply passage to control fluid flow to the second hydraulically operated perforating device, the second rupture disc providing a seal against fluid flow from the fluid supply passage to the second hydraulically operated perforating device and fluid flow to detonate the second hydraulically operated perforating device being possible only when the second rupture disc is burst by fluid pressure, the first rupture disc being burstable by a lower fluid pressure than the second rupture disc.

In accordance with another broad aspect of the present invention, there is provided a method for sequentially perforating a plurality of intervals in a well, the method comprising: running into a well with a wellbore perforating assembly including: a first hydraulically operated perforating device; a second hydraulically operated perforating device; a fluid supply passage leading to the first hydraulically operated perforating device and to the second hydraulically operated perforating device; a first rupture disc in the fluid supply passage to control fluid flow to the first hydraulically operated perforating device, the first rupture disc providing a seal against fluid flow from the fluid supply passage to the first hydraulically operated perforating device and fluid flow to detonate the first hydraulically operated perforating device being possible only when the first rupture disc is burst by fluid pressure applied thereagainst and a second rupture disc in the fluid supply passage to control fluid flow to the second hydraulically operated perforating device, the second rupture disc providing a seal against fluid flow from the fluid supply passage to the second hydraulically operated perforating device and fluid flow to detonate the second hydraulically operated perforating device being possible only when the second rupture disc is burst by fluid pressure, the first rupture disc being burstable by a lower fluid pressure than the second rupture disc; positioning the assembly with the first hydraulically operated perforating device in a selected position in the well; pressuring up the fluid supply passage to a first pressure sufficient to burst the first rupture disc and detonating the first hydraulically operated perforating device to create a first perforated interval in the well; repositioning the assembly with the second hydraulically operated perforating device in a selected position in the well; pressuring up the fluid supply passage to a pressure higher than the first pressure sufficient to burst the second rupture disc and detonating the second hydraulically operated perforating device to create a second perforated interval in the well.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE ATTACHMENTS

Referring to the attachments, several aspects of the present invention are illustrated by way of example, and not by way of limitation, in detail, wherein:

FIGS. 1*a*, 1*b*, 1*c*, 1*d* and 1*e* are schematic sequential views illustrating one possible embodiment of a method according to the present invention showing a bottom hole assembly in a well.

Figure 4A:
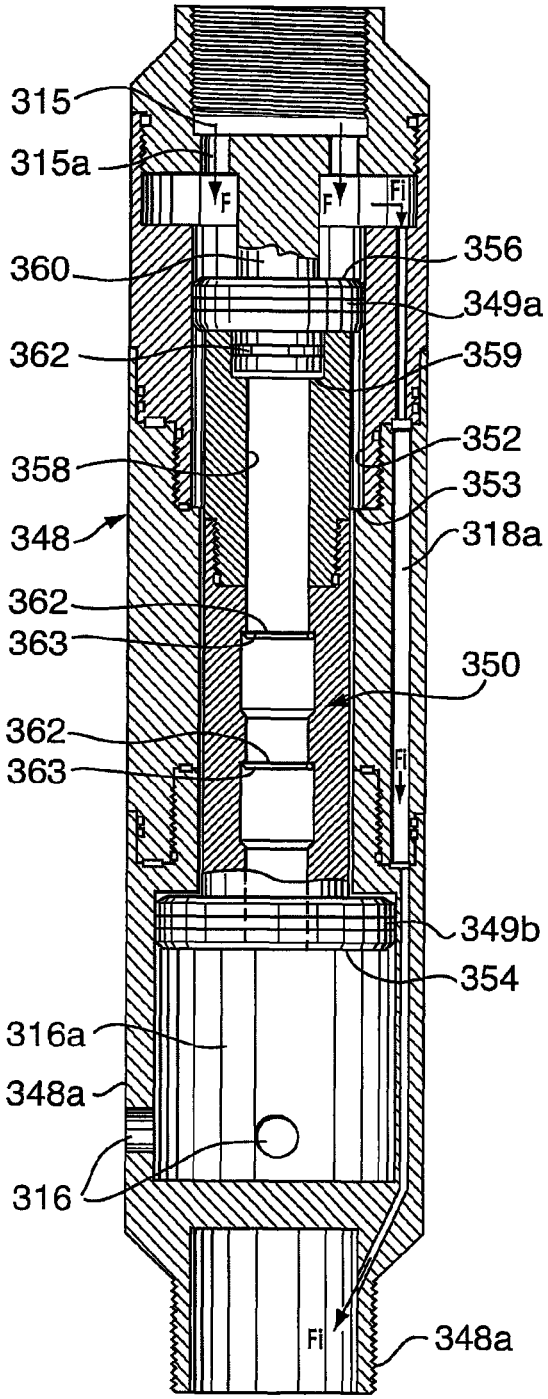
Figure 4B:
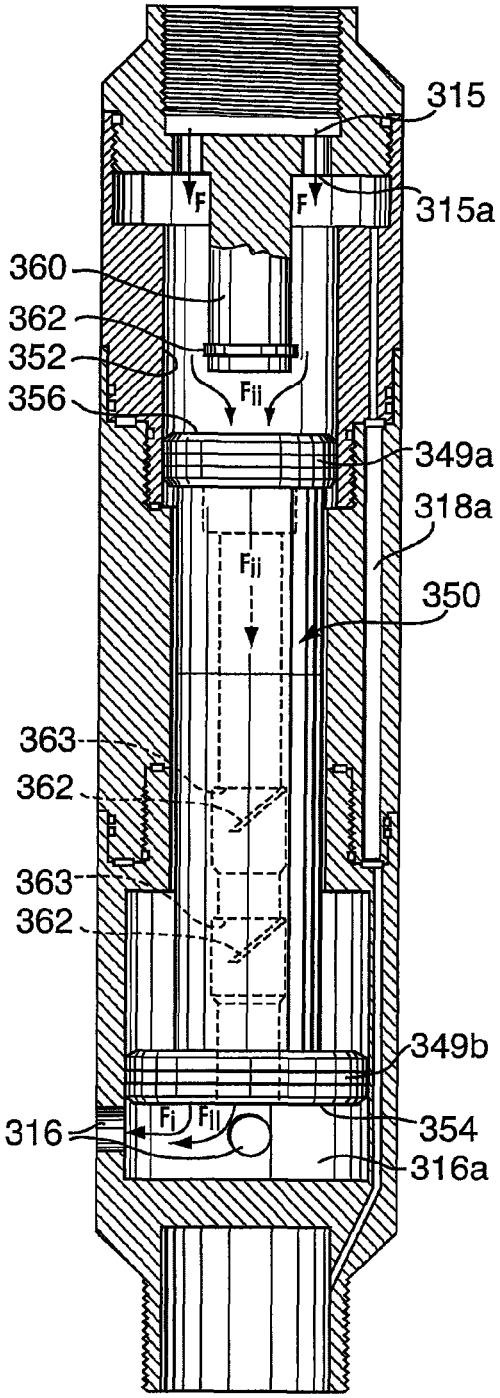

FIGS. 4*a* and 4*b* are axial sectional views through a bidirectional circulation sub useful in the present invention, showing two orientations thereof.

Figure 5A:
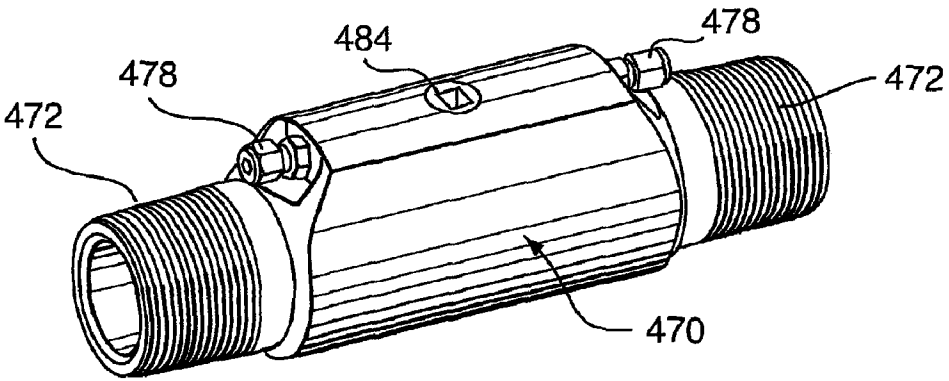
Figure 5B:
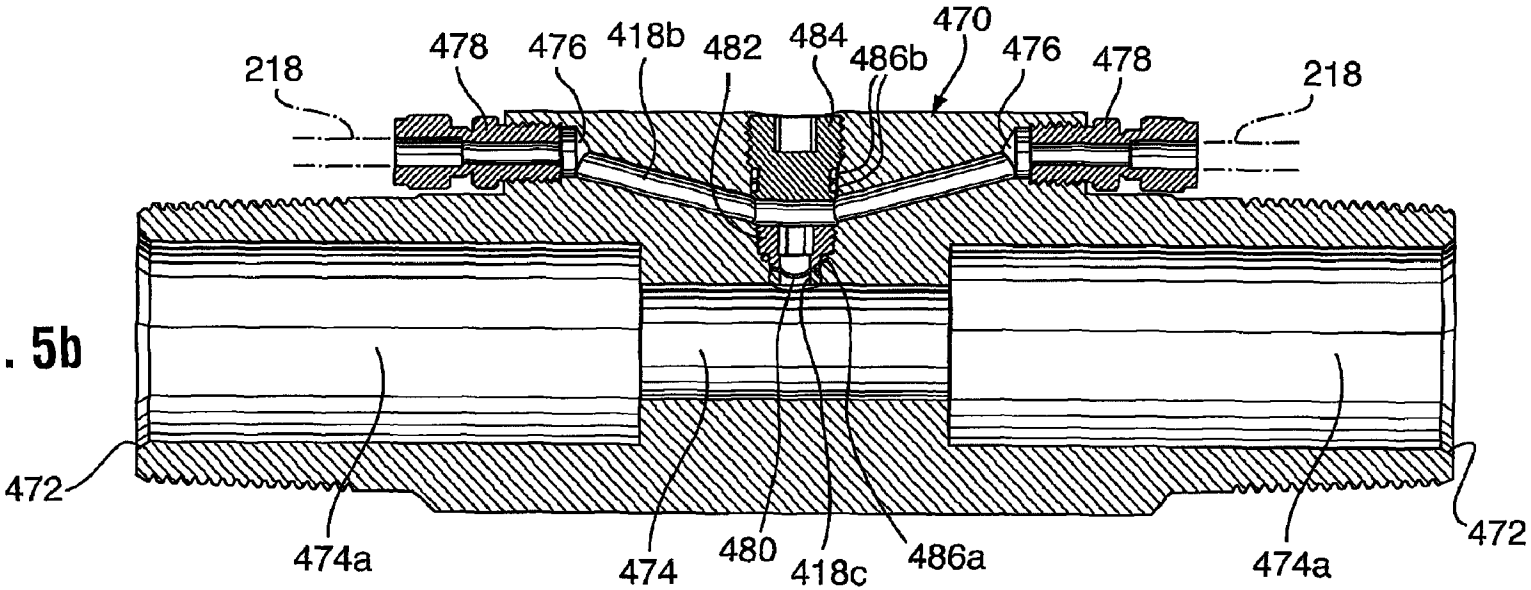

FIGS. 5*a* and 5*b* are isometric and an axial sectional views, respectively, of a bypass sub useful in the present invention.

Figure 6:
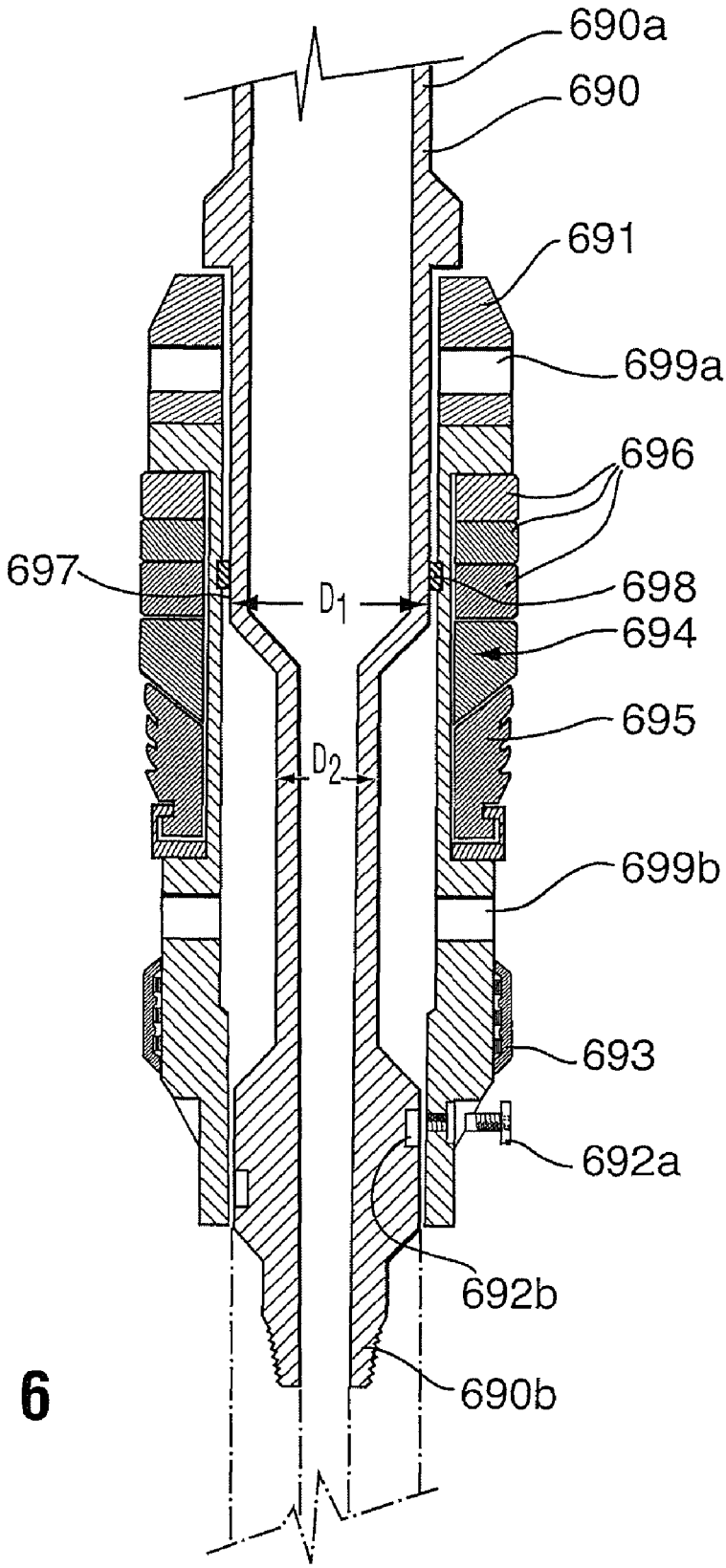

FIG. 6 is an axial section through an annular sealing member useful in the present invention.

DESCRIPTION OF VARIOUS EMBODIMENTS

The detailed description set forth below is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

The inventions described herein relate to various tools and methods for perforating multiple intervals in a well, possibly in one trip into the well, and may include also treating the multiple intervals after the perforating operation.

With reference to the sequence of drawings in FIG. 1, in one embodiment, a method for perforating and treating a well having a wellbore wall 12 employs a tool 14, also called a bottom hole assembly, run in on a work string 13, such as coiled tubing, jointed tubulars, wireline, etc.

Tool 14 includes fluid flow passages, shown as an inlet fluid passage 15, an outlet port 16 and a perforating fluid passage such as a perforating gun actuation fluid supply conduit 18 through which extends a fluid channel, a valve 19 for controlling fluid flow, a resettable, annular sealing member 20 encircling the outer surface below the outlet port; and one or more perforating devices, shown here as three perforating guns 22*a*, 22*b*, 22*c* connected below the resettable, annular sealing member and hydraulically actuable to detonate by fluid communication through the perforating fluid passage. There can be as many guns of different sizes and different charge types/number of charges, for as many zones as required. Generally, the number of guns run below the packer can range from 1 to 10, or more, limited, for example, by the allowable length of tools such as may be dictated by lubricator length, etc.

Figures 1A, 1B, 1C, 1D, 1E:
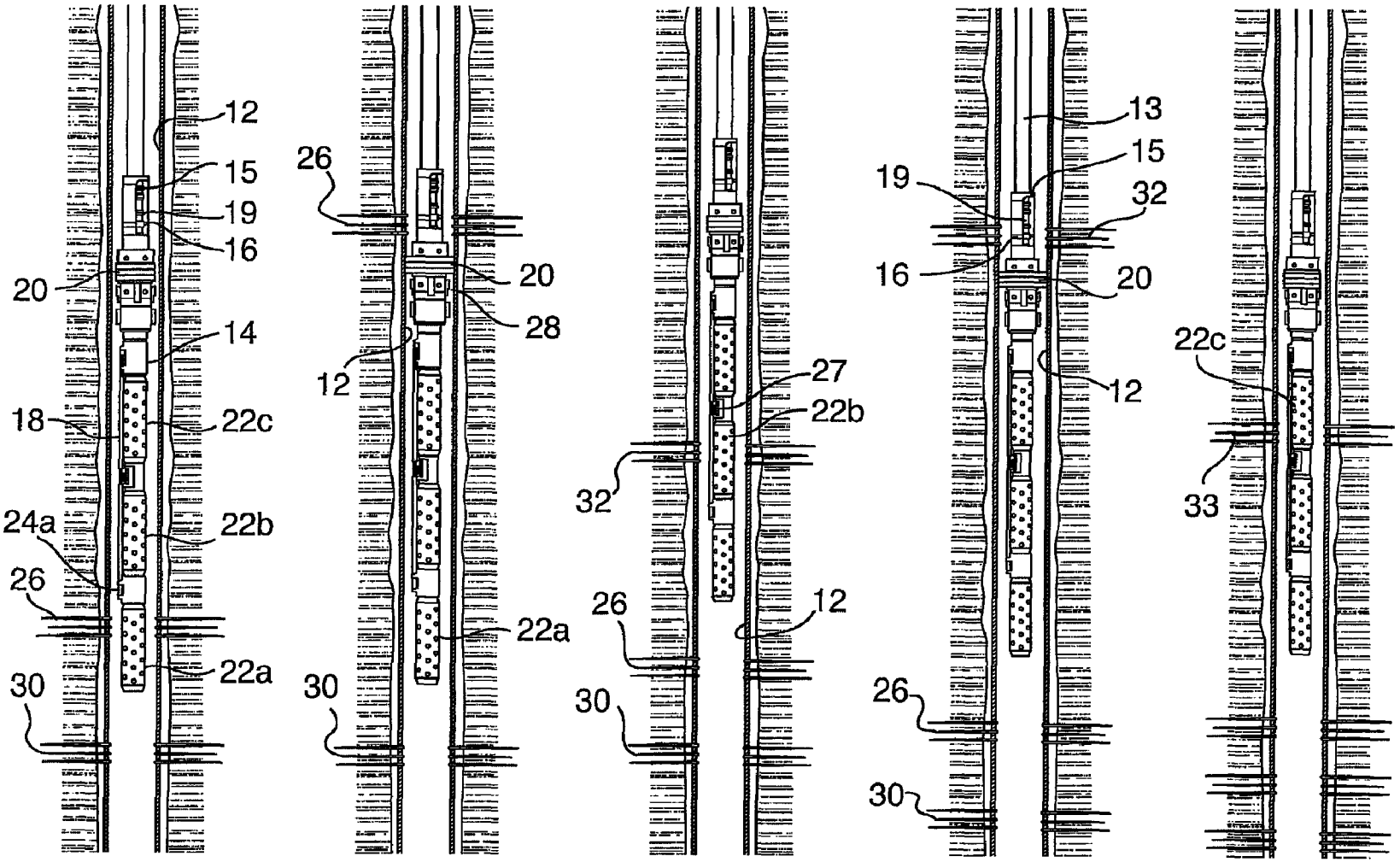

In the method, the tool is run in to a position in the well and a perforating device, in this case gun 22*a*, is detonated to create perforations 26 along an interval in the wellbore wall (FIG. 1*a*). Detonation is carried out by fluid communication from surface to a firing head 24*a* of gun 22*a*.

Thereafter, the tool is moved to set the resettable, annular sealing member to seal an annulus 28 between the tool and wellbore wall 12 below the perforations 26 just formed (FIG. 1*b*). With the annular sealing member creating a hydraulic seal in the annulus, the wellbore above member 20 is isolated from the wellbore below the member. As such, fluid operations above the member are isolated from well structures, such as previous perforations 30, etc. below. With the annular sealing member set to create a seal in the well, the well, and, generally of greater interest, the formation accessed by the well and perforations 26, may be treated by communicating treatment fluid to perforations 26, pressuring up the annulus 28, etc. Treatment fluid may be communicated from surface through the tubing 13 and/or through the annulus.

The path of fluid flow through tool 14, either to detonate the guns or to the annulus is controlled by valve 19. The fluid control valve may react to pressure differentials across the valve, comparing fluid pressures on one side of the valve with the fluid pressure on the other side of the valve. Generally, the pressure differentials will be generated between fluid in passage 15 on one side of the valve, called tubing pressure, and pressure about the exterior of the tool, called annulus pressure, which communicates through ports 16 to an opposite side of the valve.

After fluid treatment, the resettable annular sealing member 20 may be unset. Thereafter, the process may be ceased by pulling the tool to surface. However, as noted, the ability to treat multiple zones in a well in one trip into the well is of interest. As such, without returning the tool to surface, the process may be repeated on another interval of the well. In particular, the tool may be run to another position in the well and one of the undetonated perforating devices, in this case gun 22*b*, is detonated to create perforations 32 along an interval in the wellbore wall (FIG. 1*c*). Thereafter, the tool is moved to set the resettable, annular sealing member to seal the annulus 28 again between the tool and wellbore wall 12, this time below perforations 32 and above perforations 26, and the formation accessed by the well, may be treated by communicating treatment fluid through coil 13, passage 15, valve 19 and ports 16 to perforations 32 (FIG. 1*d*). Alternately or in addition, fluid may be introduced through the annulus to perforations 32. The annulus may be pressured up, etc. Reverse flow from annulus 28 into the tool is resisted by valve 19, such that pressure conditions and treatment fluids in the annulus can be isolated from contaminating coiled tubing 13 and from contaminating and accidentally detonating guns 22.

Thereafter, member 20 can be unset and the process can be repeated, for example by repositioning the tool and detonating gun 22*c* to form further perforations 33 (FIG. 1*e*), through which treatment fluid can be pumped for treatment of the formation accessed by perforations 33.

At any time during the process or thereafter, the tool can be pulled out of the well.

In one embodiment, multiple intervals of the wellbore may be perforated and treated in a single trip into the well before pulling out of the well. The affected intervals in which the tool operates may be cased, uncased, horizontal, non-vertical, vertical, deviated, etc. Use of fluid pressures to configure the tool between a mode for detonation of the perforating devices and a mode for fluid treatment/circulation permits straightforward operations, and reduces and possibly eliminates any need for electrical connection of the tool to surface, which thereby increases the depths to which the tool can be run.

Using the bottom hole assembly as described, fluid can be circulated while running in hole. The well can be perforated using pressure to activate the perforating guns. In one embodiment, the guns are detonated using different firing pressures for each gun. In such an embodiment, the pressure used for the detonating the first gun is generally the lowest, and the pressures used for further guns increase sequentially. Generally, the perforating guns are detonated while the packer remains unset, in order to avoid packer damage caused by firing-generated forces and to provide a greater volume for force dissipation.

After setting, the packer can be pressure tested for seal integrity, as by a negative pressure test (i.e. bleeding off well pressure) above the packer. If packer integrity is in question, the packer can be pulled above the upper most perforation, set, and tested with pressure down the annulus. A perfect seal is not required, but is useful. After setting a packer, wellbore treating fluids such as for cleaning, conditioning or stimulation may be introduced through the annulus or forward circulated through the coil to the newly perforated zone. If the fluid passages and valve are oriented such that during circulation, when the valve opens access from the inlet fluid passage to the annulus, the access to the perforating fluid passage remains open, then care may be taken during circulation not to reach pressures to detonate the perforating guns. In particular, in such an embodiment, the pressure inside the coil may be applied up to a maximum of the pressure at which the tool's guns are set to detonate. In one embodiment, when high pressures are to be communicated to the formation, such as during fracturing, this may be done by pumping down the annulus while the valve closes access from the annulus to the inlet fluid passage and perforating fluid passage.

After stimulation, or whenever necessary, fluid can be pumped down the coil to circulate debris off the top of the packer. If a sand off situation, or zone lock-up is detected or appears imminent, the packer can be unset, allowing packer bypass to occur.

Figure 2:
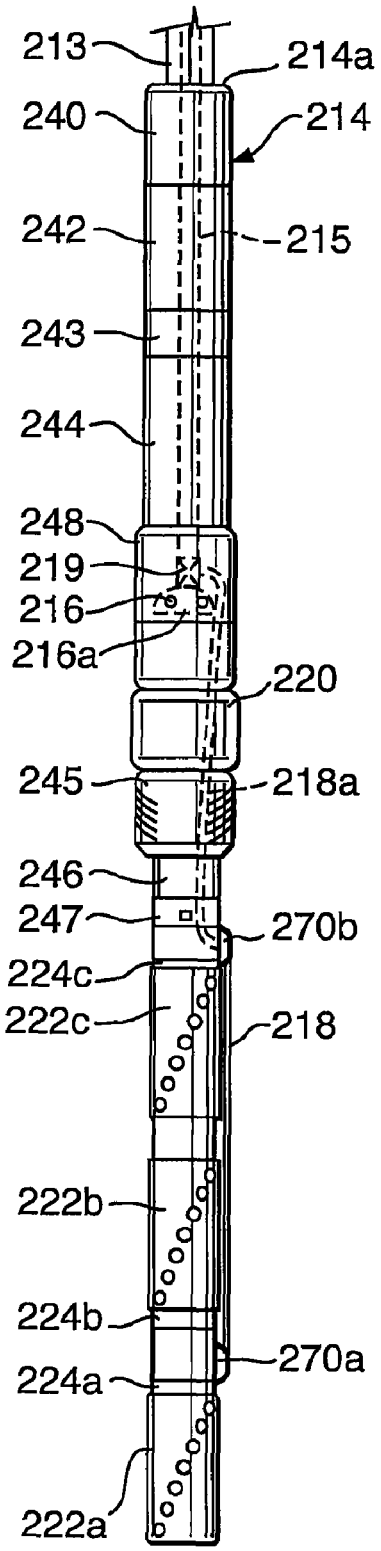
FIG. 2 is an elevation of one possible embodiment of a bottom hole assembly according to the present invention.

One embodiment of a tool 214 for perforating and treating multiple wellbore intervals is shown in FIG. 2. The tool of FIG. 2 includes a body including an outer surface and an upper end 214*a*. Fluid flow passages 215, 216, 218 extend through and/or along the body. Passage 215 opens at the upper end and extends into the body. When the tool is carried on a string 213, this passage is in communication with and accepts fluid from the inner passage of workstring 213 on which the tool is carried. Ports 216 open from the tool to the tool's outer surface which, during use, is open to the annulus about the tool to provide fluid flow from within the tool, for example passage 215, to the well. Channel 218 provides access from passage 215 to a plurality of perforating devices 222*a*, 222*b*, 222*c* on the tool, for hydraulic actuation thereof.

The plurality of perforating devices is shown here as three perforating guns 222*a*, 222*b*, 222*c*.

Tool 214 further includes a resettable, annular sealing member 220 encircling the outer surface between ports 216 and guns 222*a-c* (i.e. below the ports and above the guns).

The body may include a number of other components, as desired for specific purposes, such as a connector 240 for connecting the tool to the workstring 213 on which it is carried. In this illustrated embodiment, workstring 213 is coiled tubing and the connector is a coil-type connector. Of course, other connections can be employed.

A disconnect 242 may be provided to permit disconnection of the major tool components from the string in remedial situations, such as becoming stuck in the wellbore. In the illustrated embodiment, disconnect 242 is a ball-type disconnect that can be actuated by launching a ball from surface to pass through the string and land in and operate a disconnect in the sub.

Tool 214 may further include one or more additional subs including one or more of a crossover, a spacer, a blast joint, a scraper, a stabilizer, a slip assembly, a centralizer, a bullnose, a sensor, a recorder, a swivel, an emergency tubing drain, etc. For example, the tool illustrated in FIG. 2 includes a crossover 243, spacer/blast joint 244, a sub carrying a slip assembly and scraper 245, the slip assembly permitting actuation of the packer and the scraper acting to deburr perforations and generally clean the hole to preserve the elements of packer 220, a swivel 246, and an emergency tubing drain sub 247 selected to open just below, for example at about 80%-90%, maximum coil pressure.

As noted above, fluid flow passages extend through and/or along the body. For example, as shown in phantom, an inlet fluid passage 215 extends from upper end 214*a* through various subs to a circulation sub 248 including a valve 219. Valve 219 is selected for controlling fluid flow from the inlet fluid passage (i) to an outlet passage 216*a* and outlet port 216 and (ii) a perforating gun actuation fluid supply channel 218*a*, in this embodiment, extending in part through a conduit 218. Valve 219 is fluid pressure controlled to allow (i) flow to the exterior of the tool through ports 216, in one valve orientation, and (ii) flow to the perforating devices, in another valve orientation. The valve is moveable between the valve orientations (i) and (ii) by reaction to pressure differentials across the valve. The operation of valve 219 to communicate fluid to the exterior of the tool in one orientation and to communicate fluid to the perforating devices permits the tool to operate to both allow circulation of fluid to the wellbore and to detonate hydraulically actuated perforating guns, thereby to operate in two of the steps of wellbore perforating and treating.

One such useful valve is shown in FIG. 4. In particular, FIGS. 4*a* and 4*b* show a circulation sub 348. The valve sub in FIG. 4*b* is shown positioned in a wellbore defined by wall 312. Sub 348 includes a valve positioned therein which accepts fluid flow from an inlet fluid passage 315 and directs flow, in one orientation (FIG. 4*a*), to a perforating device actuation fluid supply channel 318*a* leading to perforating devices connectable below (for example below end 348*a* and in communication with lower chamber 318*a*' into which channel 318*a* communicates) and in another orientation (FIG. 4*b*), to an outlet passage 316*a* and ports 316 to an outer surface 348*a* of the sub, which is open to the wellbore. When in the orientation of FIG. 4*a*, the valve directs flow to the perforating device actuation fluid supply channel, while sealing against flow to the outlet passage 316*a*. In the orientation of FIG. 4*b* as illustrated, while communication to both outlet passage 316*a* and channel 318*a* is open, the flow is to passage 316*a* and out through ports 316. However, it is to be understood that, if desired, when flow to outlet passage 316*a* is open, the valve may be configured to close fluid communication to the perforating guns.

In the illustrated embodiment, the valving between the flow paths is provided by a piston 350 acting in a bore 352 of the body of the sub. Seals 349*a*, 349*b* may be provided on piston 350 to avoid fluid leaks between the piston and bore 352 in which it rides. As such, all fluid seeking to pass along bore 352 is directed by the action of the valve. Passage 315 opens to bore 352 through ports 315*a* and bore 352 is open to passage 316*a* at its lower end.

Piston 350 includes a bore 358 extending from one end to the other through which, when unobstructed, fluid can flow and piston 350 moves relative to a stem 360 extending into bore 352, which regulates fluid flow through the piston's bore. Stem 360 is sized, and as shown may carry a seal 362, to fit and create a seal within a portion of bore 358. As piston moves, the bore is either advanced over and seals about stem 360 to block flow through the bore or the bore is withdrawn from about the stem to open the bore to fluid flow. When stem 360 is seated in bore 358, flow is blocked therethrough, but fluid can flow from passage 315 to channel 318*a*. When the piston bore is withdrawn from an overlapping position relative to stem 360 (FIG. 4*b*), the fluid passing from ports 315*a* may pass through bore 358 to ports 316. While, in this illustrated embodiment, access remains open to channel 318*a*, the flow is through bore 358 due to the closed configuration of channel 318*a*. However, since fluid pressures will communicated to channel 318*a*, it may be useful to provide a valve, for example, related to piston 350 that closes fluid communication through channel, when the valve is open between passage 315 and ports 316. For example, in one embodiment, a sleeve may be carried on piston 350 that overlies or exposes access to channel. With such a valve, channel 318*a*, and the perforating devices accessed therethrough, may be prevented from seeing pressure while circulating through the sub.

Stops may be provided to limit the range of movement of the piston within the housing. For example, bore 358 may include a stop, formed for example, by a shoulder 359 defined therein that limits the advancement of the bore over the stem and bore 352 may include a stop, formed, for example, by a shoulder 353 defined therein that limits the movement of piston 350 down toward ports 316.

Piston 350 is moved relative to stem 360 by pressure differentials. In particular, piston 350 includes opposing piston faces 354, 356. Piston face 354 is open to annulus (wellbore) pressure through ports 316 and small piston face 356 is open to coil pressure through inlet passage 315. Piston face 354 has a surface area greater than piston face 356. For example, piston face 354 may have a surface area that is 1.25 to 3 times larger than the area of piston face 356. As such, piston 350 may move based on different effective force areas and is unbalanced, being more sensitive to pressures on one side, against large piston face 354, than on the other, against small piston face 356. The use of opposing, unbalanced setting force areas provides that even if the pressures in passage 315 and passage 316*a* are equal, the differing face surface areas tend to drive piston 350 toward passage 315 (i.e. the effective force at face 354 is greater than that at face 356). When annulus pressure is exerted on large piston face 354, the piston will move to or remain in a position with stem 360 sealing in bore 358. In this condition, fluid pressure can be applied to the smaller top piston face 356 and the piston will not move to open the valve, unless the pressure applied to face 356 is sufficient to overcome the pressure-induced force at face 354. The piston will remain in this position, closed to fluid flow through bore 358, until the coil pressure exceeds the force necessary to drive the piston to withdraw bore 358 from about the stem to allow pumping of fluids to the annulus. The necessary force can be determined by calculations employing the two piston areas. If the force applied at piston face 356 does not exceed the force applied by annulus pressure at piston face 354, coil supplied pressure through passage 315, arrow F, is directed through channel 318*a*, arrows Fi, to the perforating devices below. When the pressure differential is adjusted such that the piston is able to shift down (FIG. 4*b*), fluid circulation can be initiated from the coil out to the annulus, arrows F and Fii. Again, because of the size differential, with piston face 354 having a larger surface area than piston face 356, the coil supplied pressure must be much greater than the annulus pressure to move piston 350. However, consideration must be given as to the effects of increasing the coil pressure. As such, while pressuring up the coil may be useful to move the piston, adjustment (i.e. reduction) of the annulus pressure most readily achieves movement of the piston to open bore 358.

By providing valve with greater sensitivity to annular pressure than to coil pressure, a greater range of coil pressure manipulation is achievable without affecting the valve condition. The valve, therefore, works well with a tubing pressure detonated perforating tool. As an example, in one embodiment, 20 MPa annulus pressure acting against piston face 354 allows the coil pressure to reach a maximum of 50 MPa against piston face 356 before the piston will move to open flow to the annulus. This 50 MPa would be the maximum possible pressure of what could be used to detonate the perforating devices. Respectively, if the annulus pressure was 30 MPa, the maximum pressure that could be applied down the coil without moving the piston, (i.e. without overcoming the annulus pressure holding the piston) would be 75 MPa before the piston would move. The relationship between the pressures is due to the different areas of the two piston faces against which the opposing pressures act and illustrates that small pressure adjustments against the large piston face can generate relatively larger available opposing pressure conditions without affecting the valve condition.

As will be appreciated, annulus and coil pressure can each be adjusted by pumping fluids from surface or pressure relief (i.e. bleeding off at surface).

Unimpeded reverse flow past piston would reduce or eliminate the ability to establish a pressure differential across the piston. Further, reverse circulation through coiled tubing is not generally desirable. As such, a check valve is provided to resist reverse flow past the piston from passage 316*a* to passage 315. In the illustrated embodiment, a pair of one way check valves 362 are positioned in bore 358. The check valves can take various forms, but are illustrated here as flapper-type valves that seal against seats 363.

The tool operates with a plurality of hydraulically operated perforating devices, such as guns. To permit the perforation of multiple zones in one trip, at least selected ones of the plurality of guns must each be capable of detonating at a specified, spaced apart time. Such detonation of perforating devices may be achieved by time delay systems as by use of fuses, timers, etc. However, in one aspect, a simple, reliable detonation system for multiple perforating guns employs a staged pressure detonation system.

With reference back to FIG. 2, tool 214 includes a plurality of perforating devices including a first perforating gun 222*a*, a second perforating gun 222*b* and a third perforating gun 222*c*, each of the guns are hydraulically operated each including a fluid pressure responsive firing head 224*a*, 224*b*, 224*c* that are each operatively connected to a detonation assembly for their gun, including for example, one or more of a percussion initiator firing member; a transfer charge booster; and a detonation cord ultimately connected for detonation of a series of charges, such as shaped charges. Hydraulically operated perforating guns, as will be appreciated, often include a pressure responsive piston drive that can be set, as by use of shear means, to only be actuated at a selected pressure level.

Fluid supply conduit 218 including a channel 218*a* extending therethrough is connected to the guns and, in particular, to firing heads 224*a*, 224*b*, 224*c*. In order to selectively detonate one gun without risk of also detonating the further guns, pressure sensitive rupture discs may be employed. For example, a first rupture disc is provided in sub 270*a*, to control fluid flow to the first gun 222*a*. The first rupture disc provides a seal against fluid flow from the fluid supply conduit to the first firing head and fluid flow to detonate the first gun 222*a* is possible only when the first rupture disc is burst by fluid pressure at a first pressure applied thereagainst. A second rupture disc is provided in sub 270*b* to control fluid flow to a further perforating gun, in this case the firing head 224*c* of gun 222*c*. The second rupture disc isolates the firing head 224*c* from fluid pressures in conduit 218 until the disc is overcome. As such, pressure communication to detonate the third gun is possible only when the second rupture disc is burst by being contacted with fluid pressures beyond its ability to hold without failing. To ensure that the first gun can be detonated before the third gun, the first rupture disc is selected to be burstable by a first pressure, which is lower than the fluid pressure needed to burst the second rupture disc. As such, the rupture discs can be overcome one at a time and, therefore, the perforating guns behind the rupture discs can be detonated one at a time, all by adjusting the pressures communicated to the rupture discs.

A separate rupture disc may be provided for each gun, if desired. Alternately, as shown, certain guns, such as guns 222*a* and 222*b* may share a rupture disc. In such an arrangement, the guns may be selected to detonate at the same pressure or the detonation pressures of the two guns may be selected to be separated by a narrow, but achievable difference. For example, for two guns 222*a*, 222*b* protected behind a single rupture disc, such as that at sub 270*a*, the first gun 222*a* may be selected to detonate at a pressure similar to or lower than that pressure selected to burst the rupture disc and the second gun may have a firing head 224*b* selected to be responsive to a pressure higher than both the detonation pressure of the first gun and the burst pressure of the rupture disc.

A bypass connector may be employed to conveniently provide for emplacement of the rupture disc and to provide communication therepast to continuing lengths of the perforating gun fluid supply conduit. For example, with reference to FIG. 5, a sub 470 is shown through which a fluid can be supplied to actuate a perforating gun. Sub 470 includes ends 472 formed for connection to adjacent tool subs, as by threading, tapering, etc. In this case ends 472 are threaded for connection between a pair of perforating gun subs. Sub 470 further includes a bore 474 extending between ends 472. The bore includes two chambers 474*a* sized to accommodate or to provide access to a perforating gun firing head assembly (not shown). A middle region of the bore connects the chambers 474*a*. A channel 418*b* for containing a supply of fluid for actuation of a perforating gun firing head extends along the body between open ends 476 into each of which a connector 478, such as a swage lock connector, can be fit to allow connection of the ends of a tubing line such as conduit 218 of FIG. 2.

Conduit 418*b* communicates with a lateral port 418*c* that opens into bore 474. If unobstructed, conduit 418*b* and lateral port 418*c* would provide a path for perforating gun actuating fluid pressures to reach any firing devices in chambers 474*a*. However, if desired, a rupture disc 480 may be positioned in the fluid path, in this case in lateral port 418*c*, to create a seal that isolates chambers 474*a* from the fluid pressures in conduit 418*b*. Rupture disc 480 may be positioned in a burst plug 482 that can be installed in port 418*c*.

An access port with a removable plug 484 may be provided to facilitate installation of burst plug 482. Seals 486*a*, 486*b* may be installed to resist fluid leaks, as desired.

Using sub 470, fluid pressure can be communicated through conduit 418*b* to guns beyond the sub. However, this pressure is isolated from any perforating gun firing devices in chambers 474*a* until a pressure is reached that overcomes rupture disc 480. Once the rupture disc is overcome, fluid pressure in conduit 418*b* is communicated to bore 474 and into contact with any firing head devices in chambers 474*a*. Those firing head devices can be selected to cause detonation of their guns at the same pressure or at different pressures, as described above.

Of course, sub 470 could be modified to only have one chamber 474*a* or to create an end of conduit 418 (i.e. by having only a portion of conduit 418*b* or a plug in place of one of the connectors).

For example, while sub 270*a* of FIG. 2 may have a form similar to that shown in FIGS. 5*a* and 5*b*, sub 270*b* accesses only one firing head 224*c* and has a flow path arising from channel 218*a*. Therefore the sub may be modified accordingly to reposition the rupture disc for head 224*c* and permit fluid bypass to line 218.

Figure 3:
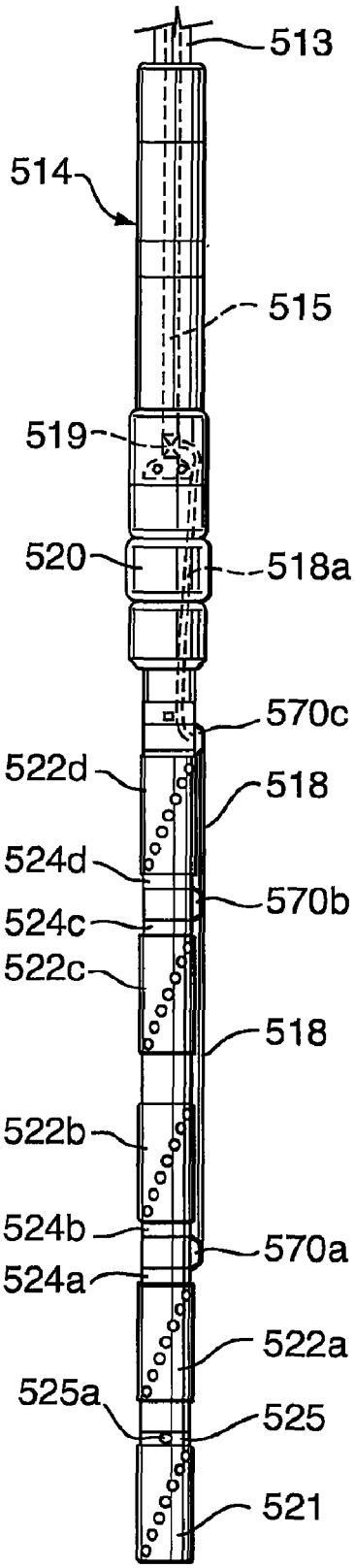
FIG. 3 is an elevation of another possible embodiment of a bottom hole assembly according to the present invention.

FIG. 3 shows another bottom hole assembly differing from that shown in FIG. 2 by the number of perforating guns and illustrates a few other alternatives and options.

The bottom hole assembly of FIG. 3, for example, has five perforating guns 521, 522*a*, 522*b*, 522*c*, 522*d*. While three guns are shown in FIG. 2 and five guns are shown in FIG. 3, the number of guns can be selected depending on the number of perforating cycles desired during use of the tool, the size of the lubricator at wellhead, etc.

In the illustrated embodiment of FIG. 3, gun 521 is detonated by annulus pressure, rather than tubing pressure and, as such, includes a firing head 525 with an opening 525*a* to the tool's outer surface. Any tool can include one or more such perforating guns, if desired. Since annulus pressure can be isolated from tubing pressure, employing combinations of guns detonated by annular pressure and guns detonated by tubing pressure may increase tool options such as the possible numbers of guns on any tool.

Guns 522*a*, 522*b*, 522*c*, 522*d* are detonated by pressure communicated from the tubing string 513 through passage 515, channel 518*a*, conduit 518 and bypass subs 570*a*, 570*b* and 570*c*. Subs 570*a* and 570*b* include burst plugs that serve to pressure isolate the guns accessed therethrough from conduit 518 until the rupture discs in the burst plugs are overcome. Sub 570*a* includes a rupture disc that permits fluid pressures to reach the firing heads of guns 522*a* and 522*b* only if pressures exceed its pressure rating and sub 570*b* includes a second rupture disc that isolates fluid pressures from the firing heads of guns 522*c* and 522*d* unless the pressure exceeds the second disc's pressure rating, which is greater than that of the disc in sub 570*a*.

As an example of a sequential detonation process for tool 514, gun 521 could first be detonated by annulus pressure at a first pressure. This would generally occur prior to setting packer 520, since the setting of the packer would pressure isolate head 525 from pressure manipulations at surface. Annulus pressure has no affect on the other guns, since those guns are pressure isolated from the annulus by valve 519.

Thereafter, guns 522*a*, 522*b*, 522*c*, 522*d* are detonated by pressure communicated from surface through coiled tubing 513 to the tool to firing heads 524*a*, 524*b*, 524*c*, 524*d*. The rupture discs and firing heads are selected and set to allow one gun at a time to detonate, depending on the fluid pressure in conduit 518. For example, the rupture discs in subs 570*a*, 570*b* can be selected to rupture to allow fluid communication therepast at pressures P1 and P2, respectively where P1<P2. Guns 522*a* and 522*b* are accessed through the rupture disc in sub 570*a* and detonate at fluid pressures FP1 and FP2, respectively, where FP1 is approximately <P1 and FP2 is >FP1, >P1 and <P2 and guns 522*c* and 522*d* are accessed through the rupture disc in sub 570*b* and detonate at fluid pressures FP3 and FP4, respectively, where FP3 is approximately ≦P2 and FP4 is >FP3 and >P2. In one embodiment, for example, P1≈30 MPa, FP1≈10 MPa, FP2≈40 MPa, P2≈50 MPa, FP3≈10 MPa and FP4≈60 MPa. In such an embodiment, as soon as the rupture disc having rating P1 bursts, the perforating gun 522*a* having actuation pressure FP1 will detonate and as soon as the rupture disc having rating P2 bursts, the perforating gun 522*c* having actuation pressure FP3 will detonate. However, until the rupture discs are overcome all tubing pressure is isolated from the firing heads.

In the tool of FIG. 3, conduit 518 and heads 524*a*, 524*b*, 524*c*, 524*d* are part of a pressure closed system so pressure differentials and zone isolation about packer 520 is not compromised by pressuring up these components, even after detonation of the guns associated therewith.

If desired, a rupture disc need not be employed for certain guns, relying only on achieving pressure actuation levels at the firing head. However, the use of rupture discs may provide a useful safety measure to avoid inadvertent detonation due to accidental pressure bumps.

The annular sealing member of the tool operates to provide zone isolation such that fluid treatments and pressure conditions can be zonally isolated along the well. The annular sealing member operates to provide a hydraulic seal encircling the tool, which may not provide a perfect seal, but which is sufficient to cause flow restriction to divert fluid away from direct flow downwardly in the well. The annular sealing member is resettable such that it can be positioned, set, used to seal the well and unset a number of times. Most commonly an annular sealing member is known as a packer. Various packers are useful in the present tool. For example, packers such as those set by inflation, compression, etc. may be used and may be set to expand or retract by mechanical, hydraulic or electric means.

In one embodiment, a mechanically operated, compression set packer may be useful. Such a packer may be operated to expand by manipulation of the tubing string, such as string 213 of FIG. 2. One possible packer is shown in FIG. 6. A mechanically operated, compression set packer such as that shown may include a mandrel 690 and a sleeve 691 carried on the mandrel and connected to axially slide and rotate on the mandrel.

Mandrel 690 includes a bore therethrough which, in this embodiment, is a portion of the perforating gun actuation fluid supply channel, such as may be connected into communication with passage 318*a* of FIG. 4. Since this channel is in communication with the coil and the perforating guns, it is useful that the bore of the mandrel remains closed to the exterior throughout the packer.

The movement of the sleeve relative to the mandrel is guided by a pin 692*a* riding in a slot 692*b* and the differential movement of the sleeve relative to the mandrel is driven by drag blocks 693. The sleeve carries the annular packing element 696, a compression assembly 694 for expanding the packing elements radially outwardly including slips 695 for securing the sleeve in position in the wellbore. The operation of such a packer is understood by those skilled in the art, wherein the movement of mandrel 690 within sleeve 691 drives compression and therefore expansion of the packer and other movement of the mandrel within the sleeve causes unsetting of the packer. Since the mandrel is attached at ends 690*a* and/or 690*b* into the tool, which is connected to a string, manipulation of the string can drive the packer. For example, in the illustrated embodiment, applied force from above to mandrel, such as weight from the string connected above end

690*a*, acts to drive sleeve 691 down relative to slips 695 to compress and expand the packer elements 696 in between and pulling up on the mandrel, such as by pulling up on the workstring from surface, releases the compression pressure and unsets the packer.

It is noted, however, that some difficulties may arise where it is desirable to unset the packer but significant pressure differentials exist across the packing element. In this regard, the illustrated mandrel includes an openable bypass around the packer, but which does not open into the inner bore of the mandrel. In particular, in the present embodiment, mandrel 690 includes seating area 697 that seals with sleeve and to prevent fluid passage between the mandrel and the sleeve, but mandrel includes a small diameter region at D2 adjacent the seating area. Seating area 697 for sealing with the sleeve's seals 698 is positioned on a large diameter region of the mandrel, shown by D1, but adjacent a narrowing region in the mandrel to smaller diameter D2. When the packer is set, seals 698 are positioned on the large diameter region of the mandrel but axial movement of the mandrel within the sleeve moves the seating area from under the seals and is replaced by the small diameter mandrel region. When this occurs a large annular area is opened between the mandrel and the sleeve for pressure equalization across the packer between ports 699*a* above and 699*b* below.

Because there may be a considerable weight resisting upward movement of the mandrel, seating area 697 may be positioned close adjacent the narrowing region. Since the pressure above the packer is likely to be much greater than that below, the flow area through bottom ports 699*b* may be selected to be at least approximately equal to the annular area between the sleeve and the smaller diameter region of the mandrel to avoid any resistance to pressure equalization.

EXAMPLE I

A specific method was proposed based on FIG. 1. Surface wellhead pressure (WHP) will range from 10 MPa to 35 MPa, resulting from zone#1 perforations 30. Zone #1 perforations will be made by performing a first single gun run and performing a fracturing job by pumping down the casing. Data from that first run will determine the setup of tool 14.

1. Construct tool 14 and snub/run the assembly into the well.
2. Perforate zone #2 causing perforations 26 above perforations 30. When doing so, the packer 20 is unset. Perforating is done by applying pressure down coil 13. Pressure is transferred through bi-directional valve 19, and perforating gun supply lines including through the packer mandrel, and the external control line 18 to bottom gun 22*a*. The bi-directional valve may be already closed to circulation, meaning the perforating gun supply lines may be immediately pressured up. Alternately, if the valve is opened to circulation, the valve should first be actuated to close to permit communication with the perforating guns. The operator will know the condition of the valve based on well conditions. If the tool was run in while circulating, the valve may be open. If so, the annulus pressure must be increased, as by pumping down the annulus while leaving the coil open, to close the valve (i.e. close communication between the coil and the annulus). However, the valve may be closed intentionally or simply by reacting to the hydrostatic action of inserting the tool. In that case, the guns could be actuated directly without needing to close the valve.
3. Move packer below perforations 26, set packer and pressure test isolation integrity by applying pressure down annulus. (FIG. 1*b*) After successful pressure test, bleed off annulus pressure and circulate acid (if necessary) down coil 15, taking return displacement fluid up the annulus 28. When acid is spotted across the zone, close the annulus and squeeze by applying annulus pressure. Bi-directional valve 19 will close when annulus pressure exceeds the coil pressure and prevent reverse circulation.
4. Fracturing process of zone #2 will then proceed by pumping down the annulus with fluid or fluid/proppant slurry. As pressure on the annulus side increases, coil pressure will be increased to maintain an acceptable differential pressure to ensure coil does not collapse.
5. After frac has been completed, packer will be unset and pulled up to next proposed perforation interval #3 to create perforations 32. Pressure will then be applied again down the coil to pressure activate the next perforating gun 22*b*. Guns 22*b* and 22*c* are protected from premature firing by a burst disk system inside bypass sub 27. This burst disk is compromised when pressure is increased to fire gun 22*b*.
6. Tool 14 is moved to position packer 20 below perforation interval 32, coil 13 is manipulated, and the packer is set. (FIG. 1*d*) Packer 20 is then pressure tested on the uphole annulus side. The process including steps 4 and 5 is then repeated for this zone by acid and/or frac stimulation.
7. Process of completing each zone is continued until all guns are expelled, or packer needs to be changed due to wear.

EXAMPLE II

Another specific method was proposed to perforate four zones in a cased well and fracture stimulate using a coiled tubing rig any of various fluids including slick water, sand laden, gas assisted, etc. The proposed method is as follows:

Run in hole with tools to perform clean out, inspection, etc., as necessary.

Perforate a first interval, zone #1, using a perforating gun run in on coiled tubing and frac with, for example, proppant laden fluid.

Attach a bottom hole assembly such as, for example, on similar to that described in FIG. 2 above. Well has a residual well head pressure.

Assemble tools in the lubricator and pressure test the lubricator system by pumping on the annulus side. Once pressure is equation to the wellbore pressure, open the well, allow pressure to equalize and run the tool into the well on coiled tubing.

Coil should remain open while miming in-hole, or have a static pressure applied and held on coil to prevent coil collapse if annulus pressure is high. In this embodiment, circulation is not recommended while running in due to the constant changing of applied pressure (circulation+ applied hydrostatic on gun system). If necessary, circulation will be done in a forward direction and the lubricator will be pressure tested by pumping down the coil through the valve, and into the lubricator. This is done to start running with the coil open. If the valve is closed, the system can be pumped down the hole by pumping down the annulus. Returns will not reverse up the coil. Pumping will flow directly into perforation zone #1.

While running in hole a maximum miming speed will be set.

Once depth is reached, the coil will go beyond required depth and pull up in tension to position perforation gun #1 in position.

At this point, gun is in position, packer is unset, and there is pressure on the well. The bi-directional valve needs to be closed to shoot the guns. In order for this to happen, coil pressure is bled off, allowing annulus pressure to act against the check valves and piston face of the valve, thus closing it. (i.e. driving the piston up over the stern to seal fluid flow)

Pressure can now be applied to the coil that will exceed the casing pressure and still keep the bi-directional valve closed due to its opposing unbalanced piston design. Gun #1 will be fired on depth to create perforating zone #2.

Once positive indication has been received that gun #1 has fired, the packer will be pulled up to ensure movement.

Packer will be manipulated by tubing movement to return to run position. Packer will then be positioned below the perforation zone #2, manipulated, and set in position. Slack off weight will be applied to packer.

Negative pressure test of wellbore can be performed at this time by releasing annulus pressure at surface. This also reduces the annulus pressure such that the valve in the circulation sub can be opened.

Stimulation fluid, such as acid can then be forward circulated down coil. The bi-directional valve will open allowing this. Once acid has been circulated to bottom and up annulus side, coil can be shut in at surface and the fracturing process of zone #2 with sand laden fluid can be initiated. Over flush, if desired, to clean up any residual sand in wellbore.

Immediately after frac, pump rates will be shut off, and coil will be pulled to release packer. Pumping can then be resumed down the annulus to help flush debris through the packer. Coil will pull only a short distance until the packer has had time to equalize. 5 min recommended. Pulling the packer through the perforations is not recommended. Low rate pumping down annulus can continue to help cleanup above packer.

After equalization time, pumping can be stopped if necessary and coil can pull up-hole to position perforation gun #2 into shoot position at a zone #3.

With pressure on the annulus, and packer unset, coil pressure can be released to ensure the valve is closed and then applied to fire gun #2. The pressure to fire gun #2 is greater than that required to fire gun #1. After positive indication of detonation, packer will again be manipulated to be positioned below the perforations just formed at zone #3. The packer can then be set and pressure tested.

Procedures will continue until all desired zones are perforated and completed.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. For US properties, no claim element is to be construed under the provisions of 35 USC 112, sixth paragraph, unless the element is expressly recited using the phrase "means for" or "step for".

We claim:

1. A bottom hole assembly for one trip perforating and treating a wellbore, the bottom hole assembly comprising: a tool body including an outer surface and an upper end; a fluid passage extending into the tool body from the upper end; a valve to provide (i) in a first orientation, fluid access from the fluid passage to an outlet port opening to the outer surface and (ii) in a second orientation, fluid access from the fluid passage to a perforating gun actuation fluid supply channel while sealing fluid access from the fluid passage to the outer surface; an annular sealing member encircling the outer surface below the outlet port; and a perforating gun carried below the annular sealing member and hydraulically actuable to detonate by fluid communication through the perforating gun actuation fluid supply channel, wherein the valve operates to move between the first orientation and the second orientation in response to pressure differentials established across the valve between fluid pressure in the fluid passage and fluid pressure at the outlet port; and wherein the valve includes a large piston face having a first surface area acted upon by the fluid pressure at the outlet port and a small piston face having a second surface area acted upon by the fluid pressure in the fluid passage and the first surface area is greater than the second surface area such that the valve is unbalanced, being more reactive to fluid pressure at the outlet port than fluid pressure in the fluid passage.

2. A method for perforating and treating a well having a wellbore wall including: (a) providing a bottom hole assembly including a tool body including an outer surface and an upper end; a fluid passage extending into the tool body from the upper end; a valve to provide (i) in one orientation fluid access from the fluid passage to an outlet port opening to the outer surface and (ii) in another orientation fluid access from the fluid passage to a perforating gun actuation fluid supply channel while sealing fluid access from the fluid passage to the outer surface; an annular sealing member encircling the outer surface below the outlet port; and a perforating gun below the annular sealing member and hydraulically actuable to detonate by fluid communication through the perforating gun actuation fluid supply channel; (b) running the bottom hole assembly to a position in the well; (c) actuating the valve to provide fluid access from the fluid passage to the perforating gun actuation fluid supply channel to detonate the perforating gun to create perforations in the wellbore wall; (d) moving the bottom hole assembly to set the annular sealing member to seal an annulus between the bottom hole assembly and the wellbore wall below the perforations; (e) treating the well by communicating treatment fluid to the perforations; and (f) unsetting the annular sealing member.

3. The method of claim 2 wherein actuating the valve includes raising the pressure about the bottom hole assembly and at the outlet port to create a pressure differential across the valve such that the valve is driven to seal fluid access from the fluid passage to the outer surface.

4. The method of claim 2 wherein treating the well includes lowering the pressure about the bottom hole assembly and at the outlet port to reduce any pressure differential across the valve such that the valve is driven to open fluid access from the fluid passage to the outer surface and circulating fluid from surface through the tool and out the outlet port to the well.

5. The method of claim 2 further comprising after step (f), (g) moving the bottom hole assembly to a second position in the well; (h) actuating the valve to provide fluid access from the fluid passage to the perforating gun actuation fluid supply channel to detonate a second perforating gun carried on the bottom hole assembly to create a second set of perforations in the wellbore wall; (i) moving the bottom hole assembly to position the annular sealing member between the perforations and the second set of perforations and setting the annular sealing member to seal an annulus between the bottom hole assembly and the wellbore wall below the second set of perforations; and (j) treating a formation accessed by the second set of perforations by communicating treatment fluid to the second set of perforations.

6. A tool for perforating and treating a wellbore interval comprising: a body having an exterior surface, an inlet fluid passage and a perforating fluid passage openable into communication with the inlet fluid passage; a first hydraulically operated perforating device openable into communication with the perforating fluid passage; a second hydraulically operated perforating device openable into communication with the perforating fluid passage; a wellbore sealing mechanism annularly positioned about the body; and a valve for controlling fluid flow through the inlet fluid passage to communicate the fluid to the perforating fluid passage and to communicate the fluid to the exterior of the tool above the wellbore sealing device, the valve being operable by reacting to pressure differentials between the exterior of the tool and the inlet fluid passage, wherein the valve includes a large piston face having a first surface area acted upon by fluid pressure at the outlet port and a small piston face having a second surface area acted upon by the fluid pressure in the fluid passage, and the first surface area is greater than the second surface area such that the valve is unbalanced, being more reactive to fluid pressure at the outlet port than fluid pressure in the fluid passage.

7. A method for perforating and treating multiple intervals in a well, said method comprising: (a) running into the well with a tool having a body including an exterior surface, an inlet fluid passage and a perforating fluid passage openable into communication with the inlet fluid passage; a first hydraulically operated perforating device openable into communication with the perforating fluid passage; a second hydraulically operated perforating device openable into communication with the perforating fluid passage; a wellbore sealing mechanism annularly positioned about the body; and a valve for controlling fluid flow through the inlet fluid passage to communicate the fluid to the perforating fluid passage and to communicate the fluid to the exterior of the tool above the wellbore sealing device, the valve being operable by pressure differentials between the exterior of the tool and the inlet fluid passage; (b) actuating the valve to open fluid communication to the perforating fluid passage and sealing fluid communication to the exterior of the tool and hydraulically actuating the first hydraulically operated perforating device to create perforations in a first interval of the well; (c) setting the wellbore sealing mechanism to create a hydraulic seal in the well; (d) actuating the valve to open fluid communication to the exterior of the tool and pumping treating fluid through the inlet fluid passage and the valve to the exterior of the tool and into communication with the perforations in the first interval of the well; (e) releasing the sealing mechanism; and (f) repeating steps (b) to (e) to hydraulically actuate the second hydraulically operated perforating device to create perforations in a second interval of the well and to communicate treating fluid to the perforations in the second interval.

8. The method of claim 7 wherein actuating the valve to open fluid communication to the perforating fluid passage includes raising the pressure about the tool and at the outlet port to create a pressure differential across the valve such that the valve is driven to seal fluid access from the inlet fluid passage to the exterior of the tool.

9. The method of claim 7 wherein actuating the valve to open fluid communication to the exterior of the tool includes lowering the pressure about the tool and at the outlet port to reduce any pressure differential across the valve such that the valve is driven to open fluid access from the inlet fluid passage to the exterior of the tool.

10. A method for perforating and treating multiple intervals in a well, said method comprising: (a) running into the well with a tool having a body including an upper end, an exterior surface and a fluid passage extending into the body from the upper end; a first hydraulically operated perforating device openable into communication with the fluid passage; a second hydraulically operated perforating device openable into communication with the fluid passage; a wellbore sealing mechanism annularly positioned about the body; and a valve for controlling fluid flow through the fluid passage to actuate the first and the second hydraulically operated perforating devices and to communicate the fluid to the exterior of the tool above the wellbore sealing device; (b) creating a pressure differential across the valve to actuate the valve to close fluid communication between the fluid passage and the exterior surface of the tool and to provide sufficient fluid pressure to the first hydraulically operated perforating device such that the first hydraulically operated perforating device creates perforations in a first interval of the well; (c) setting the wellbore sealing mechanism to create a hydraulic seal in the well; (d) reducing the pressure differential across the valve such that fluid communication is opened from the fluid passage to the exterior surface of the tool and pumping treating fluid through the fluid passage and the valve to the exterior surface of the tool and into communication with the perforations in the first interval of the well; (e) releasing the wellbore sealing mechanism; and (f) repeating steps (b) to (e) to hydraulically actuate the second hydraulically operated perforating device to create perforations in a second interval of the well and to communicate treating fluid to the perforations in the second interval.

11. The method of claim 10 wherein the valve is configured to be unbalanced, being more responsive to fluid pressure at the outlet port than fluid pressure in the fluid passage and wherein after creating a pressure differential across the valve to actuate the valve to close fluid communication between the fluid passage and the exterior surface of the tool, the fluid pressure in the fluid passage is raised above the fluid pressure at the outlet port without actuating the valve.

12. The method of claim 10 wherein reducing the pressure differential across the valve such that fluid communication is opened from the fluid passage to the exterior surface of the tool includes lowering the fluid pressure about the tool and at the outlet port.

13. A perforating device for sequentially perforating a plurality of intervals in a well, the perforating device comprising: a first hydraulically operated perforating device; a second hydraulically operated perforating device; a fluid supply passage leading to the first hydraulically operated perforating device and to the second hydraulically operated perforating device; a first rupture disc in the fluid supply passage to control fluid flow to the first hydraulically operated perforating device, the first rupture disc providing a seal against fluid flow from the fluid supply passage to the first hydraulically operated perforating device and fluid flow to detonate the first hydraulically operated perforating device being possible only when the first rupture disc is burst by fluid pressure applied thereagainst and a second rupture disc in the fluid supply passage to control fluid flow to the second hydraulically operated perforating device, the second rupture disc providing a seal against fluid flow from the fluid supply passage to the second hydraulically operated perforating device and wherein fluid flow to detonate the second hydraulically operated perforating device is possible only when the second rupture disc is burst by fluid pressure, the first rupture disc being burstable by a lower fluid pressure than the second rupture disc.

14. The perforating device of claim 13 wherein the second hydraulically operated perforating device detonates at a selected fluid pressure and further comprising a third hydraulically operated perforating device, the second rupture disc providing a seal against fluid flow from the fluid supply passage to the second hydraulically operated perforating device and the third hydraulically operated perforating device being operable to detonate at a pressure higher than the selected fluid pressure.

15. The perforating device of claim 14 wherein the second rupture disc is burst by fluid pressure x and the selected fluid pressure is approximately ≦the fluid pressure x and the third hydraulically operated perforating device being operable to detonate at a pressure higher than the selected fluid pressure and the fluid pressure x.

16. The perforating device of claim 13 further comprising a third hydraulically operated perforating device and a sub connected between the second hydraulically operated perforating device and the third hydraulically operated perforating device, the sub including a first chamber into which a firing head component of the second hydraulically operated perforating device fluidly communicates, a second chamber fluidly open to the first chamber and into which a firing head component of the third hydraulically operated perforating device fluidly communicates, a bore extending axially therealong connected to form a portion of the fluid supply passage and a lateral port fluidly connecting the bore with the first chamber, the second rupture disc positioned in the lateral port to provide the seal against fluid flow from the fluid supply passage to the firing head component of the second hydraulically operated perforating device.

17. A method for sequentially perforating a plurality of intervals in a well, the method comprising: running into a well with a wellbore perforating assembly including: a first hydraulically operated perforating device; a second hydraulically operated perforating device; a fluid supply passage leading to the first hydraulically operated perforating device and to the second hydraulically operated perforating device; a first rupture disc in the fluid supply passage to control fluid flow to the first hydraulically operated perforating device, the first rupture disc providing a seal against fluid flow from the fluid supply passage to the first hydraulically operated perforating device and fluid flow to detonate the first hydraulically operated perforating device being possible only when the first rupture disc is burst by fluid pressure applied thereagainst and a second rupture disc in the fluid supply passage to control fluid flow to the second hydraulically operated perforating device, the second rupture disc providing a seal against fluid flow from the fluid supply passage to the second hydraulically operated perforating device and fluid flow to detonate the second hydraulically operated perforating device being possible only when the second rupture disc is burst by fluid pressure, the first rupture disc being burstable by a lower fluid pressure than the second rupture disc; positioning the assembly with the first hydraulically operated perforating device in a selected position in the well; pressuring up the fluid supply passage to a first pressure sufficient to burst the first rupture disc and detonating the first hydraulically operated perforating device to create a first perforated interval in the well; repositioning the assembly with the second hydraulically operated perforating device in a selected position in the well; pressuring up the fluid supply passage to a pressure higher than the first pressure sufficient to burst the second rupture disc and detonating the second hydraulically operated perforating device to create a second perforated interval in the well.

* * * * *